United States Patent [19]

Kysh

[11] Patent Number: 5,046,637

[45] Date of Patent: Sep. 10, 1991

[54] CAN END SHELLS

[75] Inventor: Mark C. Kysh, Reading, England

[73] Assignee: CMB Foodcan plc, England

[21] Appl. No.: 435,459

[22] PCT Filed: Apr. 24, 1989

[86] PCT No.: PCT/GB89/00434

§ 371 Date: Dec. 1, 1989

§ 102(e) Date: Dec. 1, 1989

[87] PCT Pub. No.: WO89/10216

PCT Pub. Date: Nov. 2, 1989

[30] Foreign Application Priority Data

Apr. 29, 1988 [GB] United Kingdom ..... 8810229

[51] Int. Cl.[5] ..... B21D 51/44; B21D 43/00

[52] U.S. Cl. ..... 220/610; 72/348; 413/8; 413/56

[58] Field of Search ..... 72/336, 347, 348, 349; 413/8, 56; 220/66, 67, 610, 618–620

[56] References Cited

U.S. PATENT DOCUMENTS

| | | | |
|---|---|---|---|
| 2,311,001 | 2/1943 | Stewart | 220/619 |
| 3,525,455 | 8/1970 | Saunders | 220/619 |
| 3,537,291 | 11/1970 | Hawkins | 72/336 |
| 3,814,279 | 6/1974 | Rayzal | 220/66 |
| 3,843,014 | 10/1974 | Cospen et al. | 220/66 |
| 4,031,837 | 6/1977 | Jordan | 413/8 |
| 4,037,550 | 7/1977 | Zofko | 220/619 |
| 4,109,599 | 8/1978 | Schultz . | |
| 4,185,758 | 1/1980 | Giggard | 220/67 |
| 4,270,475 | 6/1981 | Fletcher et al. | 220/619 |
| 4,448,322 | 5/1984 | Kraska | 220/66 |
| 4,571,978 | 2/1986 | Taube et al. | 72/349 |
| 4,574,608 | 3/1986 | Bulso, Jr. | 72/348 |
| 4,713,958 | 12/1987 | Bulso, Jr. | 72/348 |
| 4,716,755 | 1/1988 | Bulso, Jr. | 72/349 |
| 4,790,705 | 12/1988 | Wilkinson et al. | 413/8 |

OTHER PUBLICATIONS

E.P. Application No. 0,103,074, pub. 3/21/84; Inventor: Nguyen; 14 pages spec. and 3 sheet drwgs.

U.K. Patent Application No. 2,107,273A; pub. on 4/27/83; inventor: Wilkenson et al.; 4 pages spec., 2 sheets of drwg.

*Primary Examiner*—Robert L. Spruill

*Attorney, Agent, or Firm*—Diller, Ramik & Wight

[57] ABSTRACT

Apparatus for forming a reinforced pressure resistant can end shell from sheet material comprises a cutting ring (11), a cutting punch shell (13) enterable into the ring (11) to blank out a disc of material therebetween, an annular draw ring (14) axially aligned with the cutting punch shell (13) to support a peripheral margin of the disc held against it by the cutting punch shell, a die center ring (15) arranged coaxially and slidably within the draw ring (14) and having an end face profiled to define a surface of a seaming panel of the can end shell, an ejector pressure ring (19) arranged coaxially and slidably within the punch shell and axially aligned with the die center ring so that when in use peripheral material of the blank is restrained between the die center ring and the ejector pressure ring, a draw punch center (16) arranged coaxially and slidably within the ejector pressure ring and reform pad (20) arranged coaxially and slidably within the die center ring to engage the central panel of the blank opposite the draw punch center. The end profile of the punch center comprises an annular radiused nose (22) surrounding and defining a central substantially frustoconical recess (23), and the reform pad comprises a central cylindrical portion, dimensioned to deform the central portion of the blank around the nose (22) of the punch center and into the recess (23), and an outer ring (31) spaced from the central cylindrical portion by an annular recess (30) dimensioned to receive the nose of the punch center; the outer ring having an inward facing frusto-conical face (311) which flares outwardly from the recess (30).

6 Claims, 11 Drawing Sheets

CAN END SHELLS

The invention relates to the production of can end shells for seaming onto the ends of can bodies to form cans capable of withstanding substantial internal pressures.

The can end shells to which the invention relates comprise an annular flange or seaming panel for seaming the shell to a can body, a frustoconical chuck wall, a flat central panel, and an annular, generally U-shaped, channel known as an anti-peaking bead connecting the chuck wall to the central panel. Apparatus for making can end shells of this type is described for example in U.S. Pat. No. 3,537,291, U.S. Pat. No. 3,957,005, U.S. Pat. No. 4,109,599, and EP 0153115. In U.S. Pat. No. 3,537,291 and U.S. Pat. No. 3,957,005, the anti-peaking bead is formed by a profiled punch acting against a fixed correspondingly profiled die. In U.S. Pat. No. 4,109,599 a preliminary shell comprising a peripheral seaming panel, a frustoconical wall and a flat central panel is formed in a first stage and, in a second stage, the central panel is moved towards the sealing panel such that a reinforcing anti-peaking bead is formed between the frustoconical wall and the central panel. The anti-peaking bead is formed largely by bending and is constituted by material from the outer periphery of the central panel of the perliminary shell. In EP 0153115 the two stages described in relation to U.S. Pat. No. 4,109,599 are carried out sequentially in a single piece of apparatus. In this case however the anti-peaking bead is formed by a reforming action which incorporates material from the frustoconical wall into the anti-peaking bead.

It is known that the resistance of a can end shell to internal pressures after seaming onto a can body is dependent upon the profile of the anti-peaking bead and thickness of the material from which the shell is made. The art of making can end shells, without tightening (reforming) of the anti-peaking bead, permitted use of aluminium sheet 0.32 mm thick for a can end of about 57 mm diameter ("206"). The combined shell drawing and reforming apparatus described in EP-0153115 permitted use of aluminium alloy sheet 0.29 mm thick with a possibility of using sheet 0.27 mm thick. In order to make can end shells from lower nominal gauge material it is desirable to make the nominal radius of the anti-peaking as small as possible whilst avoiding the creation of overworked areas in the anti-peaking bead leading to yield of material and failure under pressure.

The present invention relates to an improved method and apparatus for making can end shells from thin gauge stock material (such as aluminium alloy sheet in the range 0.245 to 0.29 mm thick) and having anti-peaking beads of small nominal radius and in which the creation of overworked regions in the anti-peaking bead are avoided.

Accordingly the present invention provides for making a preliminary shell in which a preformed anti-peaking bead in the form of a generally U-shaped channel having a relatively large nominal radius is formed in a controlled drawing action by means of corresponding profiles on a punch center, a die, and a reform pad. In a second stage, material from the frustoconical wall is reformed into the anti-peaking bead whilst being urged radially inwardly to form a final shell having an anti-peaking bead of relatively narrow nominal radius.

According to a first aspect of the present invention there is provided apparatus for forming a reinforced pressure resistant can end shell from sheet material, said apparatus comprising a cutting ring, a cutting punch shell enterable into said ring to blank out a disc of material therebetween, an annular draw ring axially aligned with said cutting punch shell to support a peripheral margin of the disc held against it by said cutting punch shell, a die center ring arranged coaxially and slidably within the draw ring and having an end face profiled to define a surface of a seaming panel of the can end shell, an ejector pressure ring arranged coaxially and slidably within the cutting punch shell and axially aligned with the die center ring so that when in use peripheral material of the blank is restrained between the die center ring and the ejector pressure ring, a draw punch center arranged coaxially and slidably within the ejector pressure ring and a reform pad arranged coaxially and slidably within the die center ring to engage the central panel of the blank opposite the draw punch center; wherein the end profile of the draw punch center comprises an annular radiused nose surrounding and defining a central substantially frustoconical recess, and the reform pad comprises a central cylindrical portion, dimensioned to deform the central portion of the blank around the nose of the punch center and into the recess, and an outer ring spaced from the central cylindrical portion by an annular recess dimensioned to receive the nose of the punch center; the outer ring having an inward facing substantially frustoconical face which flares outwardly from the recess.

The invention also provides a method of forming a reinforced pressure-resistant can end comprising the steps of providing a substantially planar metallic blank having a central portion and a peripheral portion, deforming the blank in a first deformation stage to cause movement apart of the central and peripheral portions to offset said portions out of a common plane, thus drawing the blank into a generally flanged cup-shaped configuration defined by the central portion, a generally U-shaped channel, a frustoconical wall and an annular seaming panel, and, in a second deformation stage, causing movement towards one another of the central portion and annular seaming panel to deform at least a part of the metal of the frustoconical wall into the U-shaped channel to form an anti-peaking bead of the can end shell; wherein, during the second stage, the frustoconical wall is progressively pushed radially inwardly.

The invention also provides can end shells having a particular desired profile.

A detailed description of the present invention is provided below with reference to the accompanying drawings in which.

Figure 1:
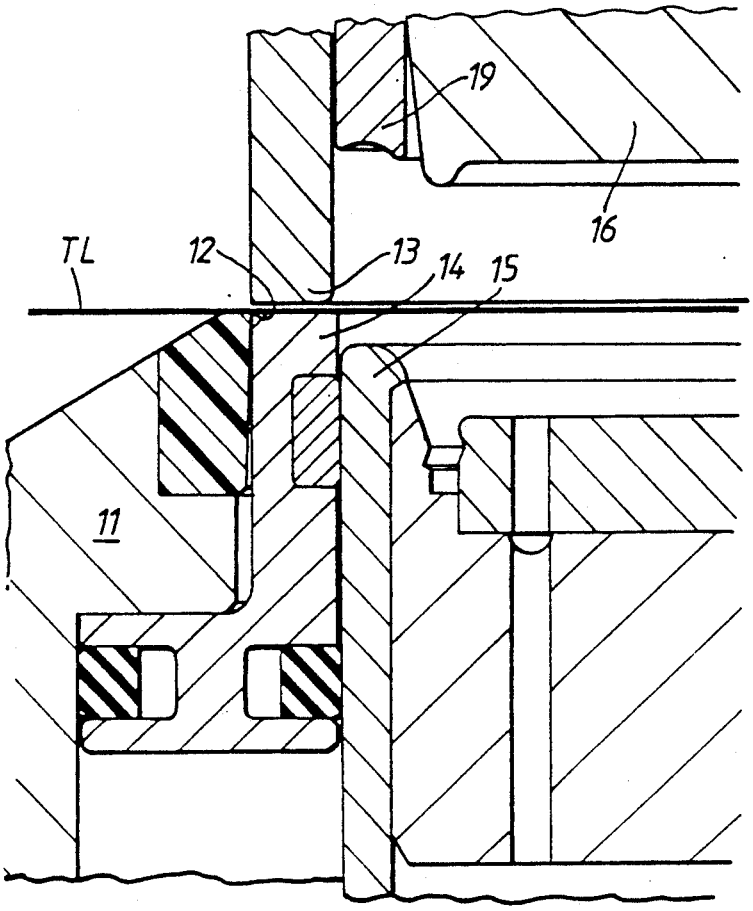
FIGS. 1–15 are partial views of apparatus for forming can end shells shown at different stages of operation.
Figure 16:
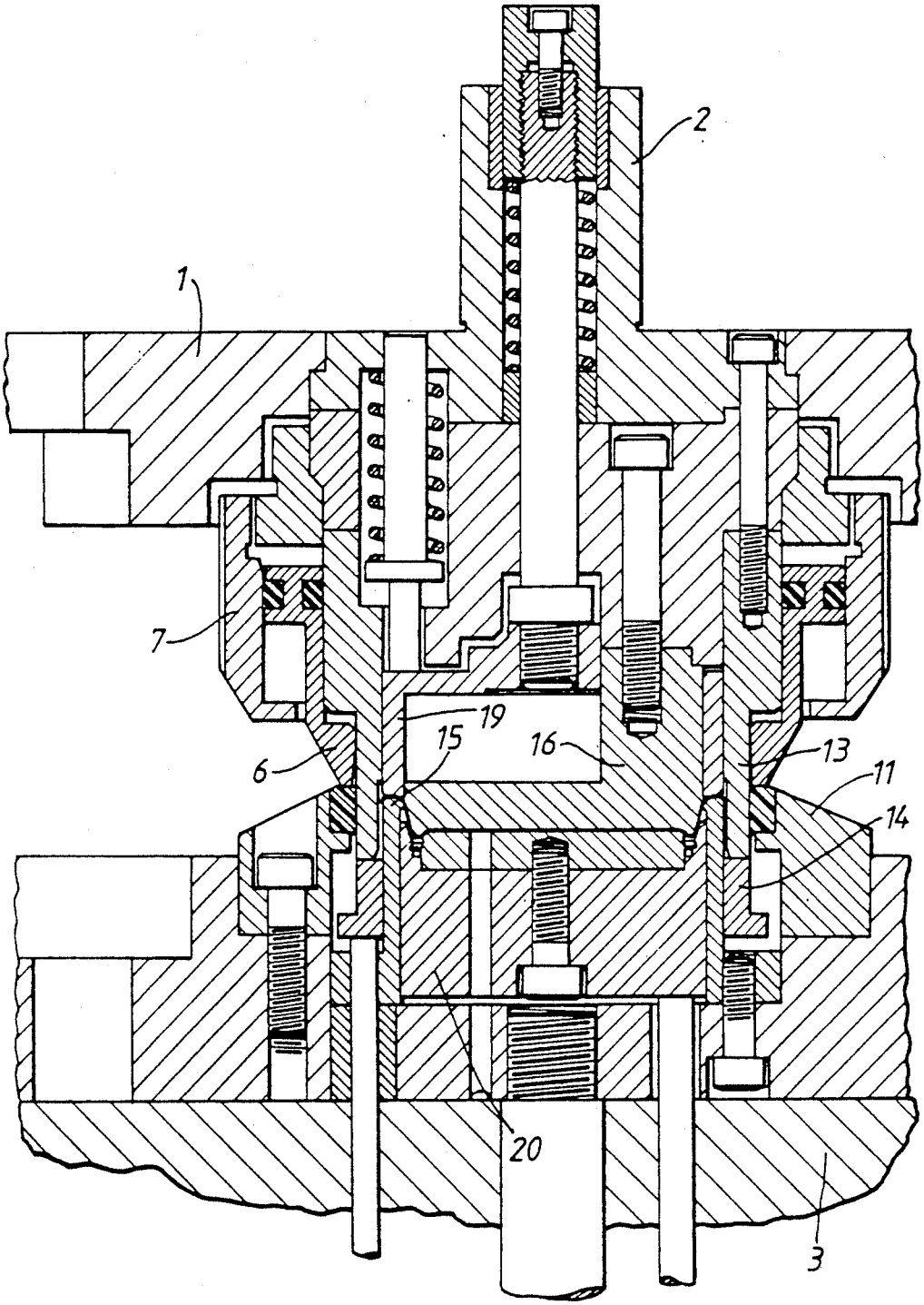
FIGS. 16 and 17 are overall views of two embodiments of apparatus for forming can end shells.
Figure 17:
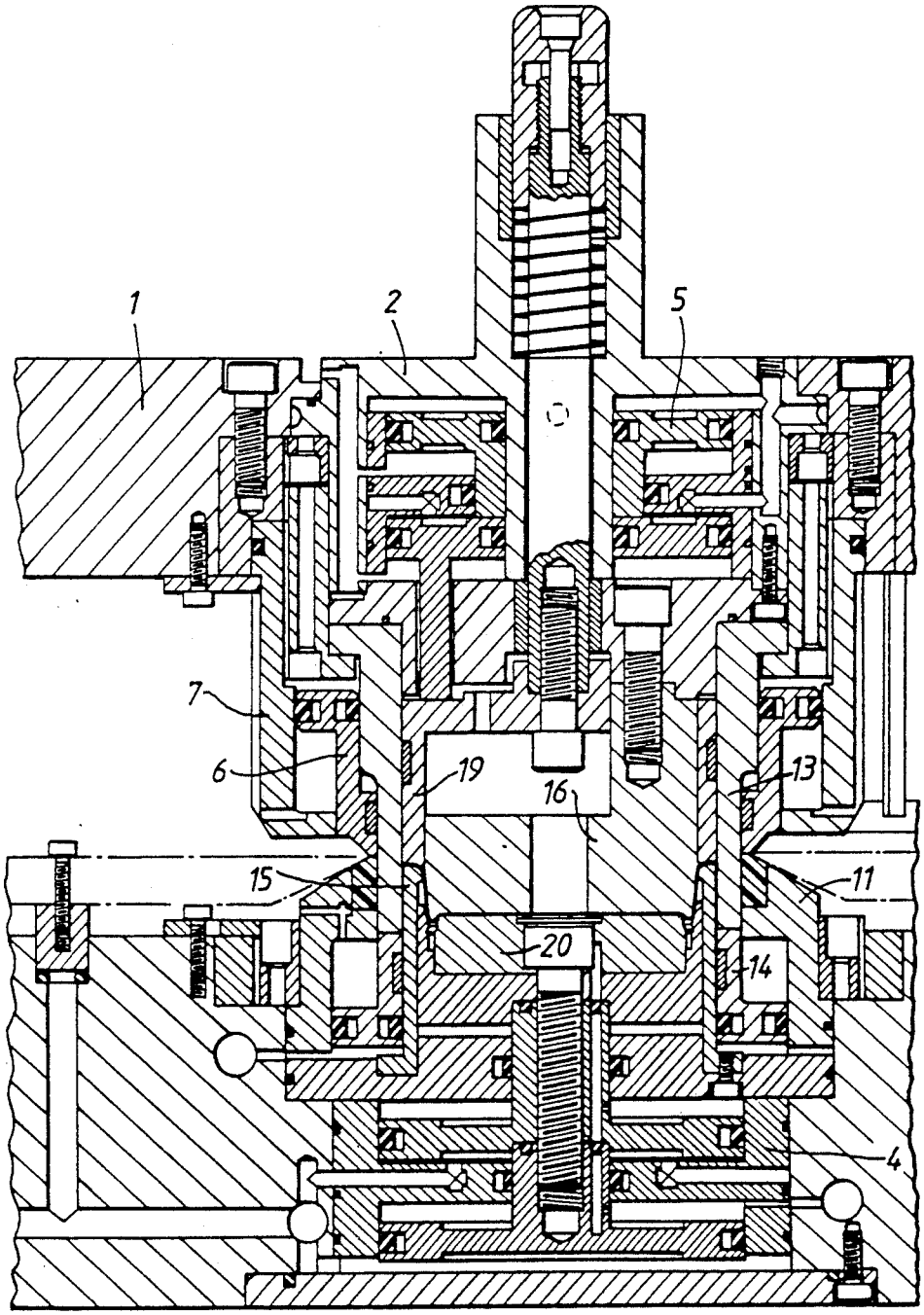

FIG. 1 shows a sheet TL of aluminum alloy or steel stock which has been fed by a standard mechanism to be positioned above the die of a double action press tool such as that shown in more detail in FIGS. 16 and 17. As shown in FIG. 1 the sheet stock is positioned immediately above the cutting ring 11 having a cutting edge 12. The punch plate 1 (See FIGS. 16 and 17) along with parts carried thereon is driven directly by the ram of the press and has descended to the point where the leading component of the punch assembly, the cutting punch shell 13, is just about to clamp the stock against an annular draw ring 14 which is resiliently supported on the die assembly such as by pneumatic (as shown), hydraulic or nitrogen pressure or by springs. As the punch assembly continues to descend a circular blank is cut by the cutting edges of the punch shell 13 and the cutting ring 11. The periphery of the blank is supported between opposed faces of the punch shell 13 and the draw ring 14 as the punch assembly continues to descend. When the die center ring 15 engages the blank, continuing descent of the punch deforms the periphery of the blank downwardly.

Figure 2:
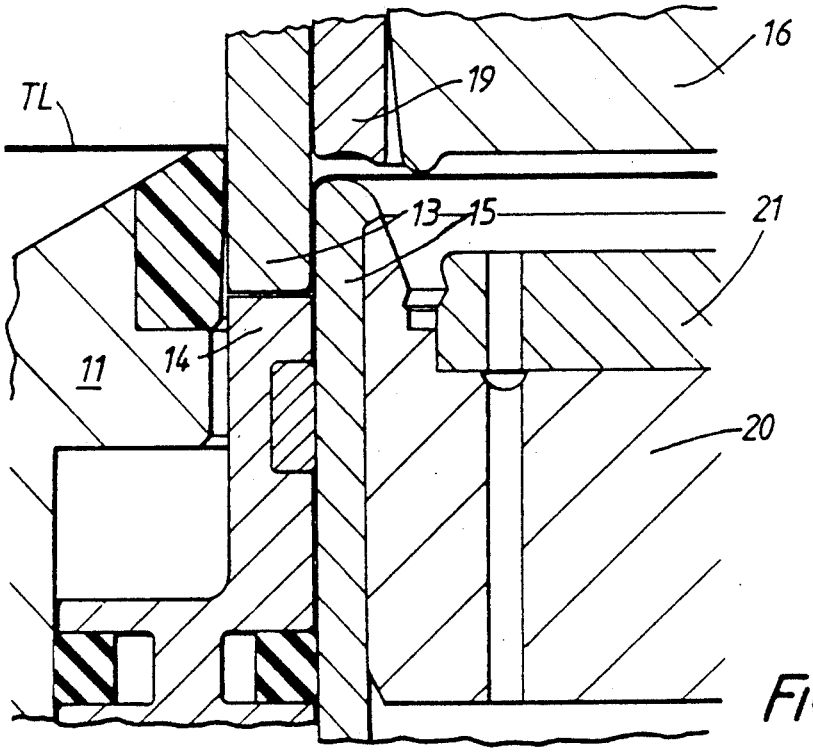

As shown in FIG. 2 the outer periphery of the blank is drawn radially inwardly between the punch shell 13 and draw ring 14 which provide sufficient pressure to prevent wrinkling. The periphery is also drawn around a draw radius at the juncture of the leading and inner faces of the punch shell. Thus the blank is formed into an inverted cup known as a reverse cup. The cup may have a flanged edge; the ratio of cup depth to flange width being dependent upon punch shell profile and press selection. The flange width is also dependent on the length of the punch shell such that a new punch shell may produce no flange whereas a re-ground punch shell may produce a slight flange.

Figure 3:
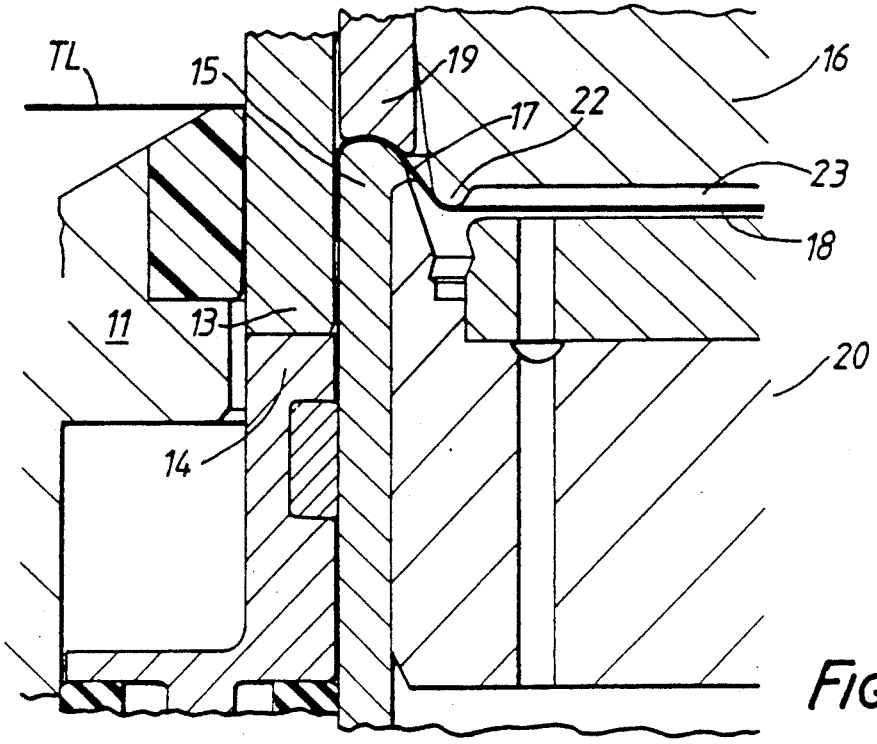

FIG. 3 shows the punch assembly's continued progress downwardly. Directly after the stage shown in FIG. 2, the punch center 16 starts to penetrate the horizontal plane of the central portion of the reverse cup, thus deforming it in a downward direction and drawing it around an inner radius on the die center ring 15, drawing it downwardly and inwardly to form a generally frustoconical wall 17 and a flat central portion 18 having a juncture of a radius determined by the punch center profile. Shortly after the downward central deformation begins, the ejector pressure ring 19 makes contact with the blank opposite the upper portion of the die center ring known as the seaming panel portion. The ejector pressure ring 19 has a concave profile complementary to the profile of the seaming panel portion of the die center ring 15 but with each radius increased by the nominal material gauge. Thus the pressure exerted by the ring 19 provides a restraining force to the portion of the blank which is drawn from the flange of the reverse cup over the convex portion of the die center ring and thus prevents wrinkling.

Figure 4:
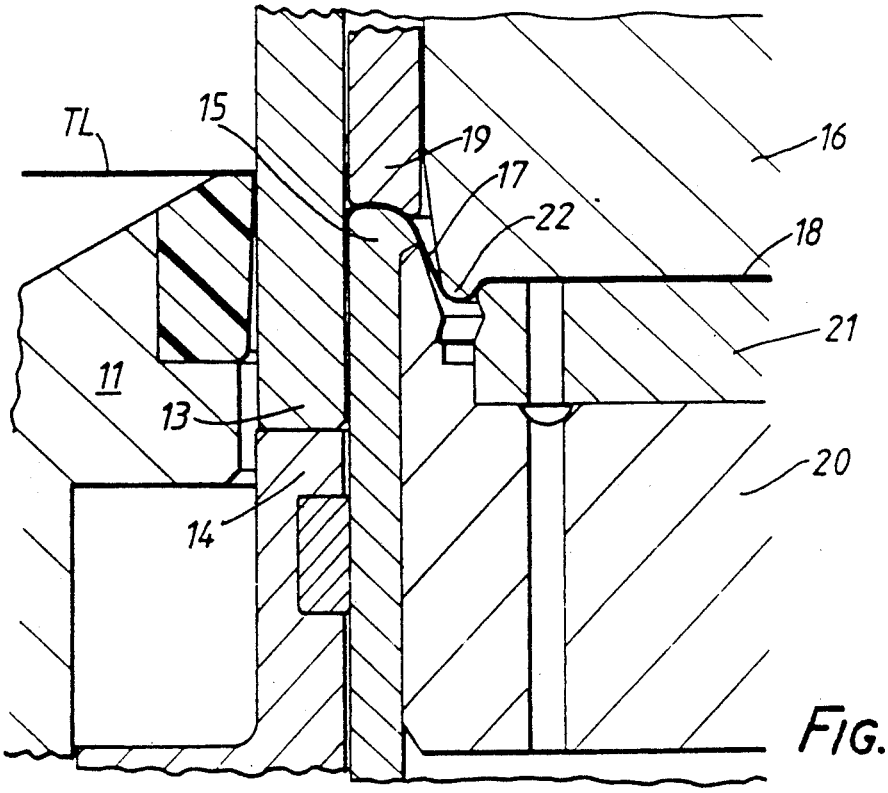

FIG. 4 shows the punch center 16 and punch shell 13 continuing to descend to the point where the flat center 18 of the blank is engaged by the reform pad 20 and is deformed in a controlled fold over the nose 21 of the reform pad and around the nose 22 of the punch center into a substantially frustoconical recess 23 in the lower face of the punch center. The reform pad 20 is resiliently (e.g. pneumatically) supported on the die assembly and from this point onwards the central panel 18 of the blank is clamped between the punch center 16 and the reform pad 20.

Figure 5:
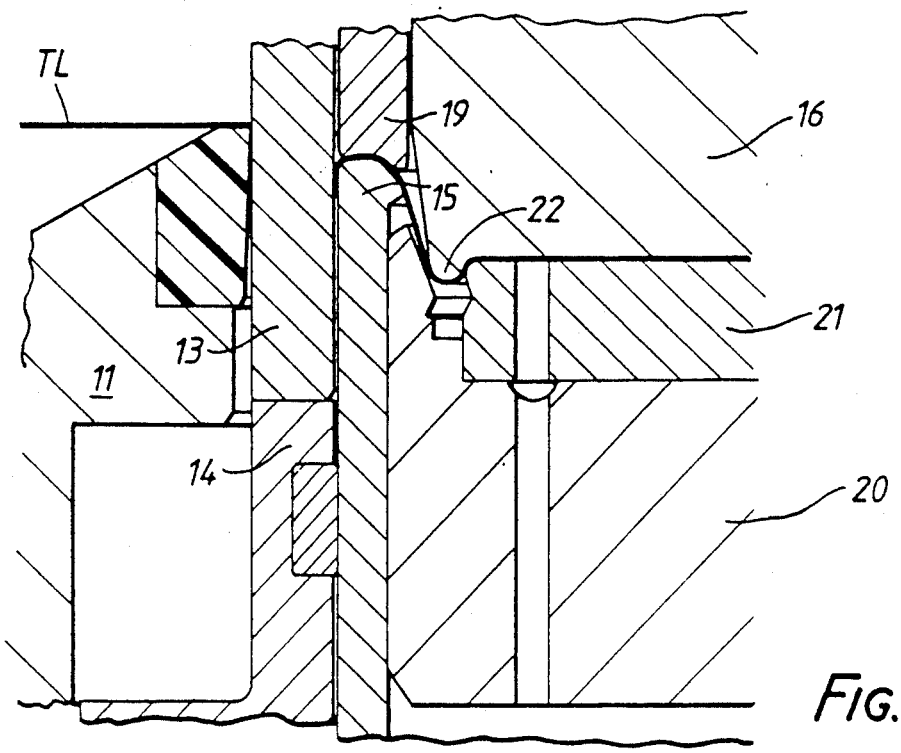
Figure 6:
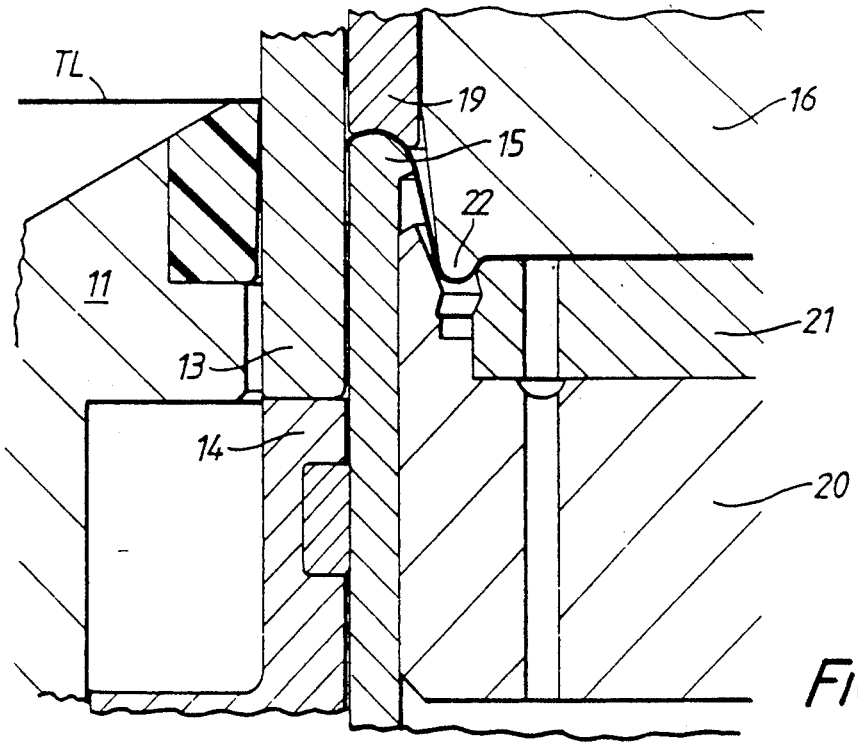
Figure 7:
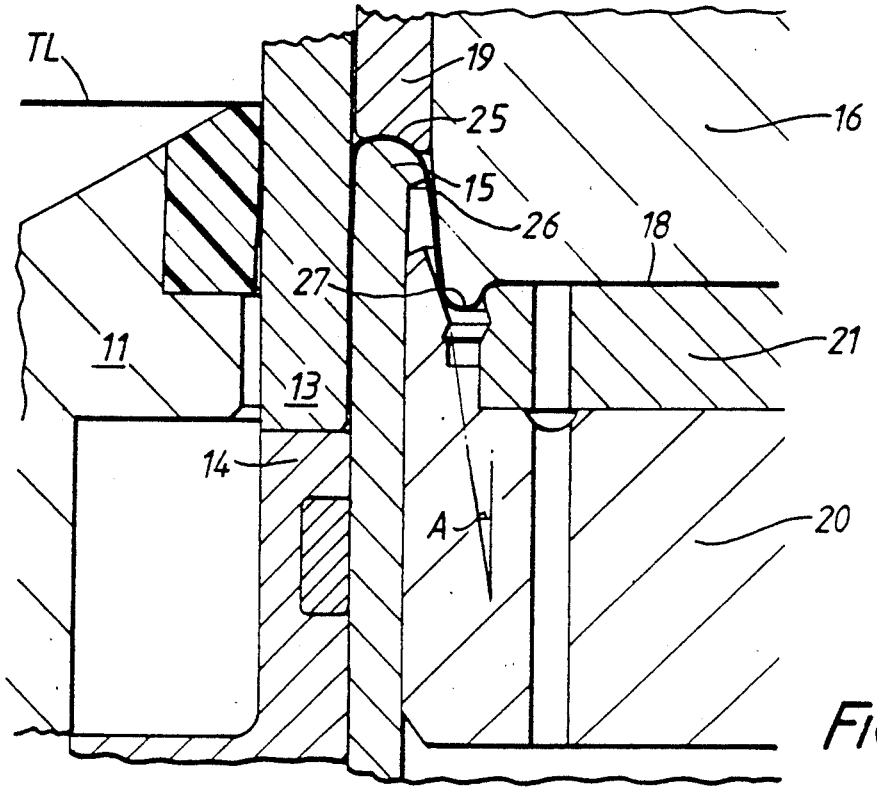

During further descent of the punch center as shown in FIGS. 5, 6 and 7, the reform pad moves downwardly relative to the die center ring and further metal is drawn from the wall of the reverse cup which is progressively sacrificed to provide a deeper frustoconical wall 17. At the point shown in FIG. 7 the ram driving the punch center 16 has reached bottom dead center, the outer edge of the blank has reached its final height, known as the start curl height, and the frustoconical wall 17 has reached its greatest depth.

At this stage a preliminary can end shell has been formed and comprises a seaming panel and start curl portion 25, a frustoconical chuck wall 26, a flat central panel 18 and a generally U-shaped channel 27 which is the preliminary form of an anti-peaking bead.

Figure 8:
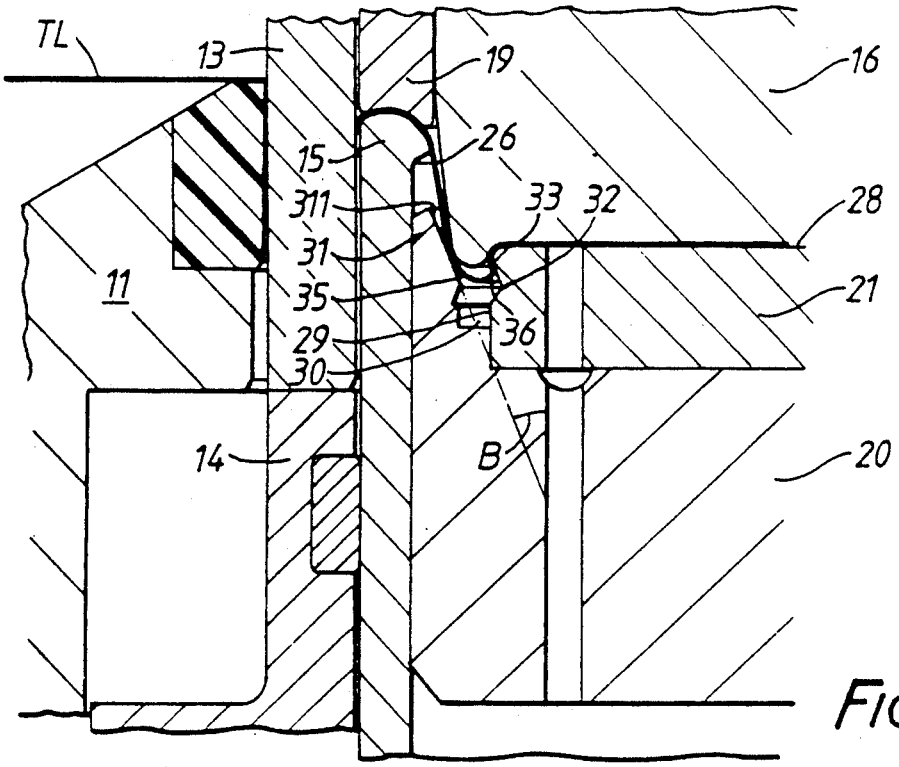
Figure 9:
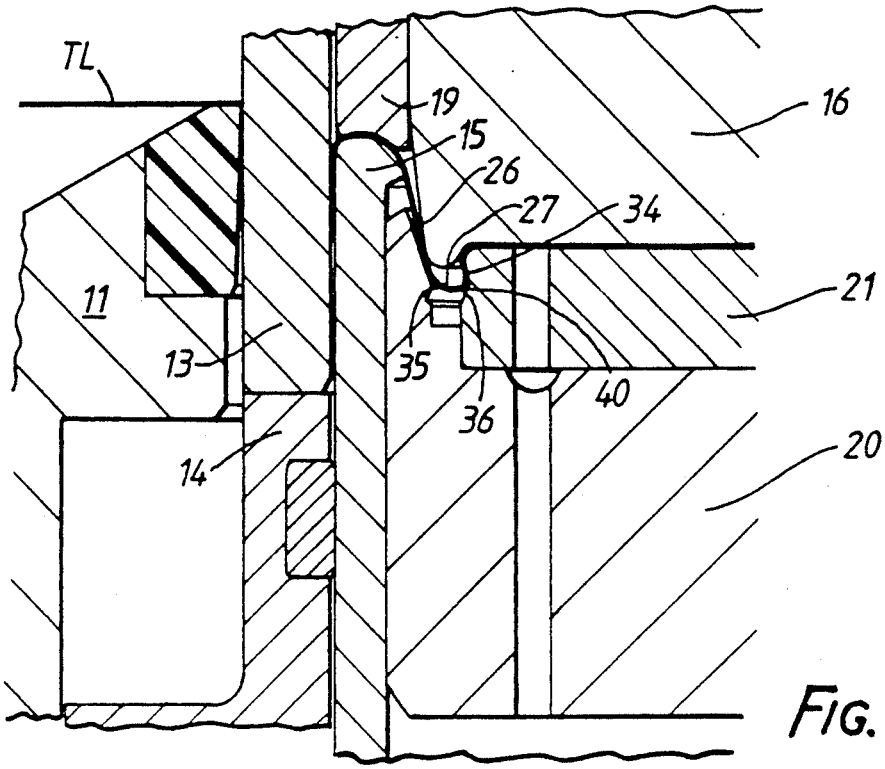

As the ram passes its bottom dead center position it begins to ascend as shown in FIGS. 8 and 9 carrying the punch center 16 and punch shell 13 upwardly. The ring 19 continues, however, to exert pressure over the seaming panel portion of the shell; the energy required being stored during the downward stroke of the ram.

Energy stored by the reform pad 20 during its downward motion causes this to follow the punch center 16 on its ascent and to exert an upward force on the central panel 18 of the can end shell to re-form the shell as described below. This force is, however, not sufficient to overcome the force applied to the seaming panel by the ring 19 so metal is not pushed back out between the die center ring 15 and the ring 19 during re-forming and the start curl and seaming panel portion 25 of the shell can therefore be considered to be isolated from the effects of the re-forming action.

Figure 10:
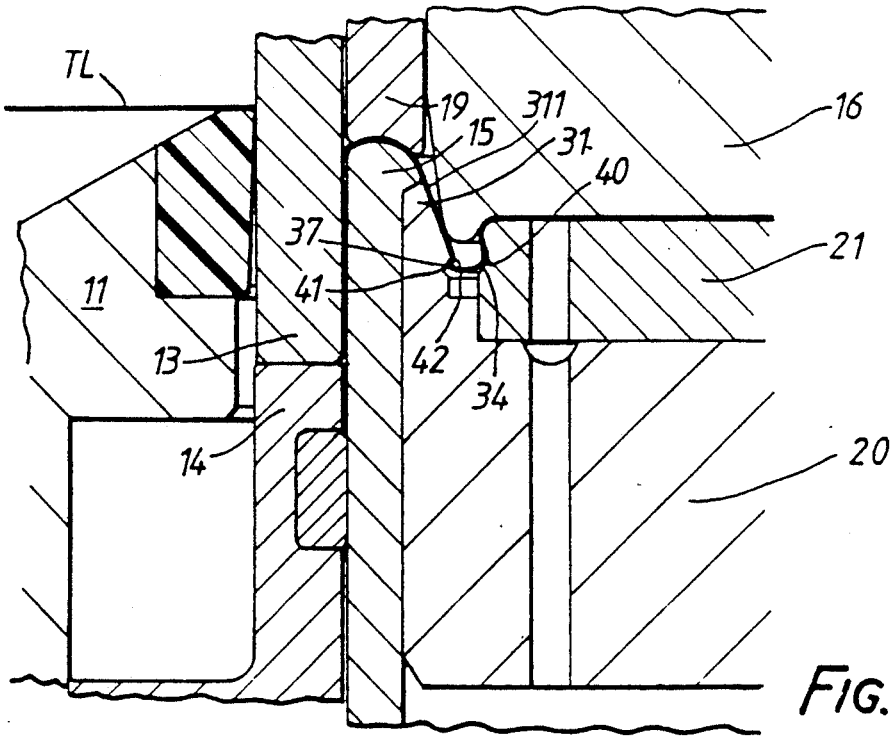

The upward force exerted by the reform pad 20 is sufficient to overcome the mecanical strength of the shell which is thus deformed as shown in FIGS. 8, 9 and 10.

As can be seen from the drawings, the reform pad comprises a central portion or nose 21 surrounded by an annular recess 30 and an outer annular ring portion 31 which has a frustoconical face 311 flaring outwardly from the recess at an angle B to the axis of the apparatus; the chuck wall 26 being inclined at an angle A when the ram is at B.D.C. (FIG.7), and angle B being greater than angle A. Thus as the reform pad rises, the outer ring 31 thereof engages the chuck wall 26 and progressively deforms it radially inwardly. This action pushes the material of the wall 26 into the anti-peaking bead 27 while the relative upward motion of reform pad nose 21 cooperates to tighten the "fold" of the channel 27.

The die center ring 15 has a re-entrant surface which forms an axial abutment for the outer ring 31 in its fully raised position (FIG. 10) where the frustoconical face 311 and the seaming panel portion of the die center ring form a substantially smooth continuous surface.

The nose 21 of the reform pad is formed with a radiused profile which accommodates the transition from the plane of the end face 28 of the reform pad which engages the central panel 18 to the generally cylindrical wall 29 of the nose 21 of the reform pad which engages the radially inner panel wall 34 of the anti-peaking bead. Immediately below the center line of this radius the nose is formed with a generally V-shaped undercut 32 which has an upper face 33 lying tangential to the nose radius. The undercut 32 provides increased clearance between the nose 21 of the reform pad and its outer ring 31 thus allowing the formation of a relatively large radius at the junction of the chuck wall and the anti-peaking bead and avoiding the creation of a critically tight radius at this point and the consequent creation of a highly strained weakened area of the shell after the material of this point has moved through the anti-peaking bead during the re-forming stage to the inner substantially cylindrical panel wall 34 of the anti-peaking bead.

FIG. 9 shows the tooling approaching the fully reformed position. Here it can be seen that the bead 27 at this stage comprises several radii; the two most important being the radius 35 at the chuck wall juncture and the radius 36 at the juncture with the panel wall 34. It is known that the nominal radius of the anti-peaking bead is related to the peaking pressure of the shell when seamed onto a can and subjected to internal pressure. It can be observed that in these circumstances the center panel 18 acts as a diaphragm which is deflected outwardly (upwards as viewed in the drawings). The result of this deflection of the central panel is to place the panel wall 34 and its radius 36 with the bottom of the anti-peaking bead under tensile force which tries to unwind the anti-peaking bead. It can be shown that the main resistance to unwinding is provided by the material of the radius 35 supported by the chuck wall. The anti-peaking bead transfers tensile force in the central panel to compressive force in the chuck wall.

It follows that provision of an anti-peaking bead having an outer radius 35 tighter than the inner radius 36 but with the nominal width of the channel forming the bead unchanged, will increase pressure reistance.

FIG. 9 shows the anti-peaking bead shortly before the end of the reforming action having a large outer radius 35 and a smaller inner radius 36—i.e. the opposite of the desired profile. It can also be seen, however, that as the panel wall 34 extends progressively into the recess 30 it contacts the lower conical face 40 of the undercut 32 which slopes downwardly and outwardly.

From FIG. 10 it can be seen that the influence of the face 40 has been to urge the panel wall 34 outwardly to become substantially cylindrical. Further it can be seen that the outer ring 31 of the reform pad is formed with an undercut 41 at the lower end of the face 311 and directly opposite the flank angle of the face 40. The undercut 41 leads to the creation of an annular convex kink 42 in the shell; being a work hardened region at the lower end of the generally conical chuck wall which resists deformation of the chuck wall when the shell is subjected to internal pressure. At the point just below the kink 42 a tight radius 37 is formed.

It will be seen that in the final form of the shell as shown in FIG. 10, the required differential between the inner and outer radii of the anti-peaking bead has been achieved and that the nominal radius of the anti-peaking bead is smaller than that of the U-shaped channel 27 as formed in the preliminary shell (FIG. 7). More specifically the can end shown in FIG. 10 has a peripheral flange ready for a final curling operation; a frustoconical wall extending axially and inwardly from the interior of the peripheral flange; an anti-peaking bead including an annular kink portion 42 and a radiused portion which extend from the frustoconical wall to joint an annular panel wall 34 which extends in a substantially axial direction to support a flat central panel 18.

Figure 11:
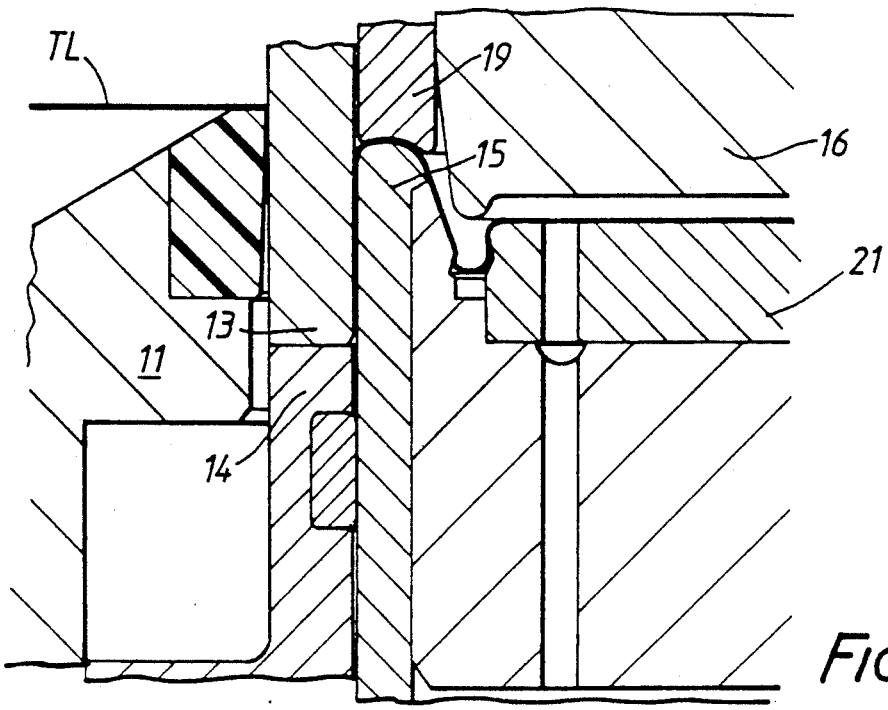

The removal of the completed shell from the apparatus is shown in FIGS. 11–15. FIG. 11 shows the tooling in ascendance immediately after the completion of the reforming action. At this point the reform pad 20 has reached its uppermost position and the center panel 18 is no longer clamped, but the seaming panel of the shell is still clamped against the die center ring 15 by the ejector pressure ring 19.

Figure 12:
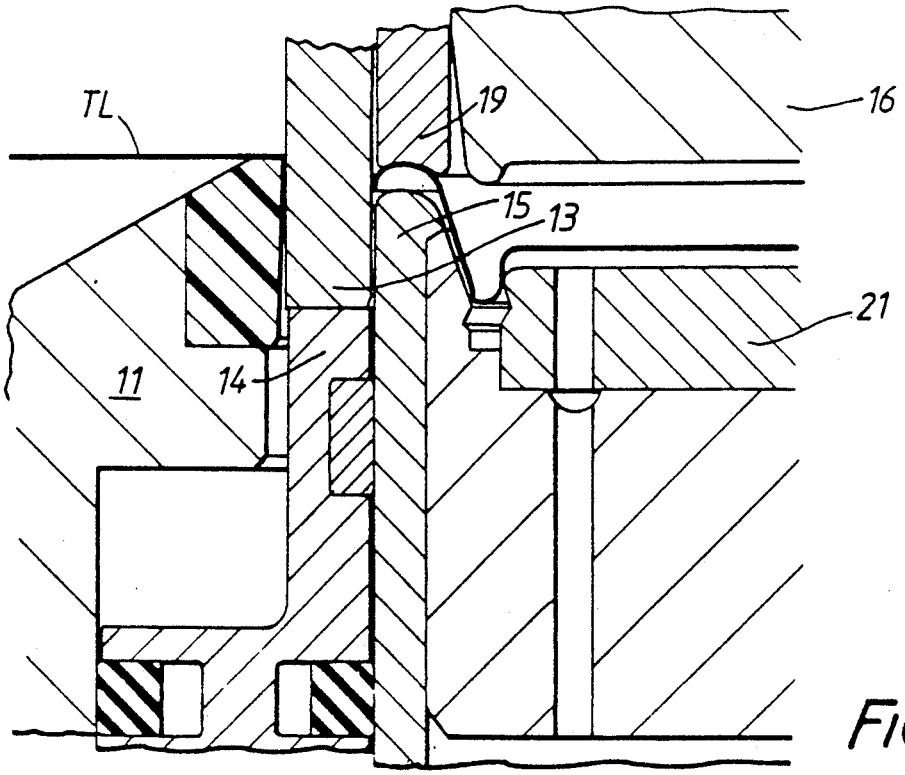

Further ascent of the punch tooling is shown in FIG. 12 where the ejector pressure ring 19 has lifted away from the die center ring 15 and resilient expansion of the shell causes it to be held within the bore of the punch shell 13 as it is raised.

Figure 13:
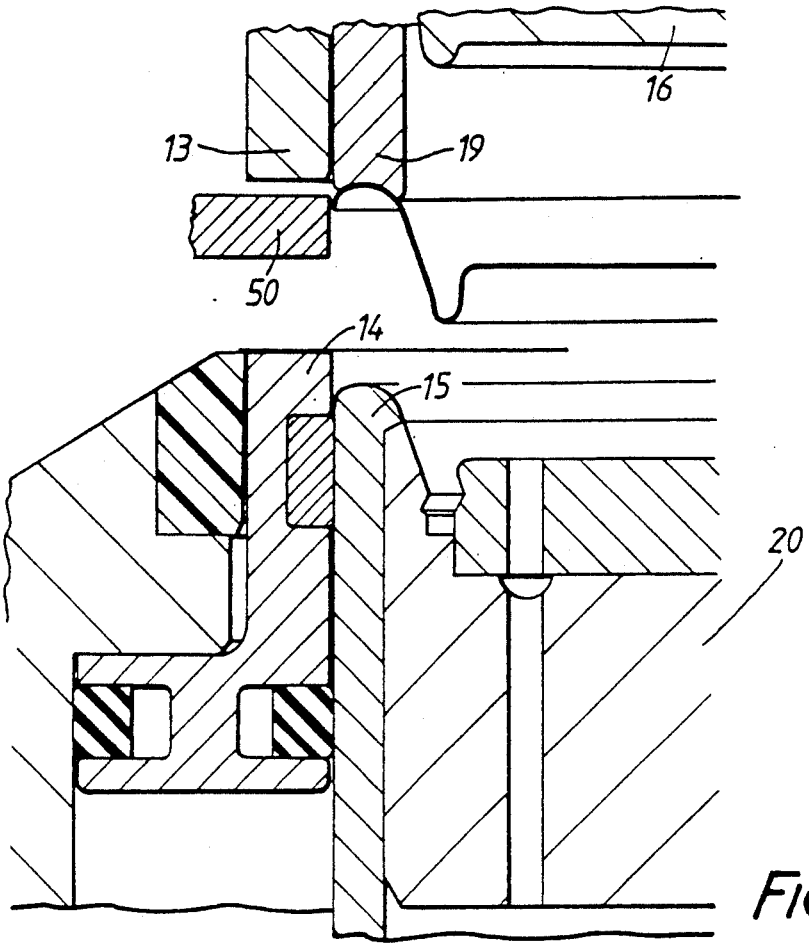

FIG. 13 shows the punch tooling at top dead center where the ejector pressure ring is actuated by a timed cam and follower to strip the shell from the bore of the punch shell. A timed kicker 50 operates to knock the shell clear of the tooling in known manner.

Figure 14:
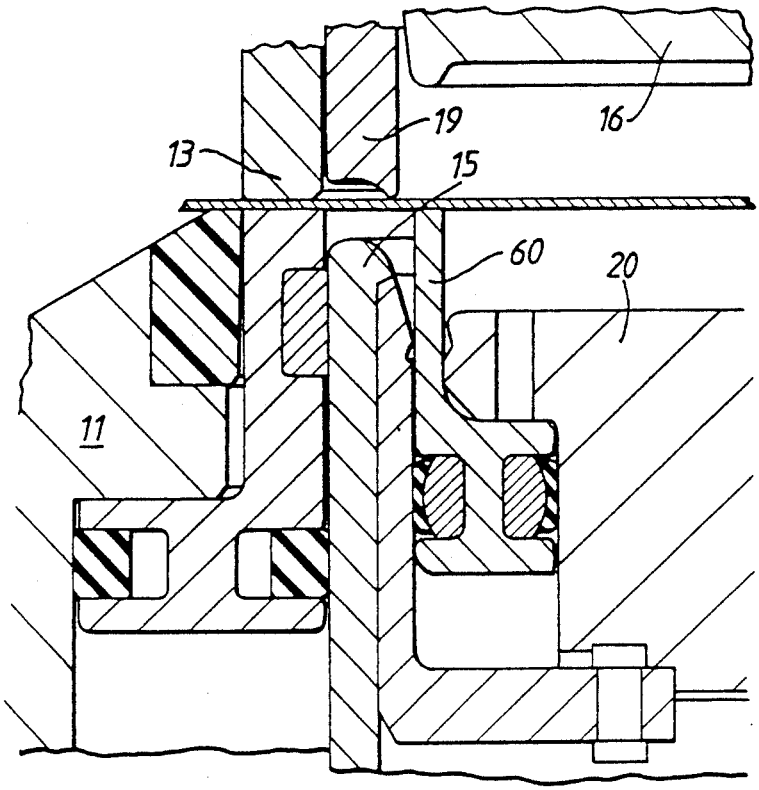
Figure 15:
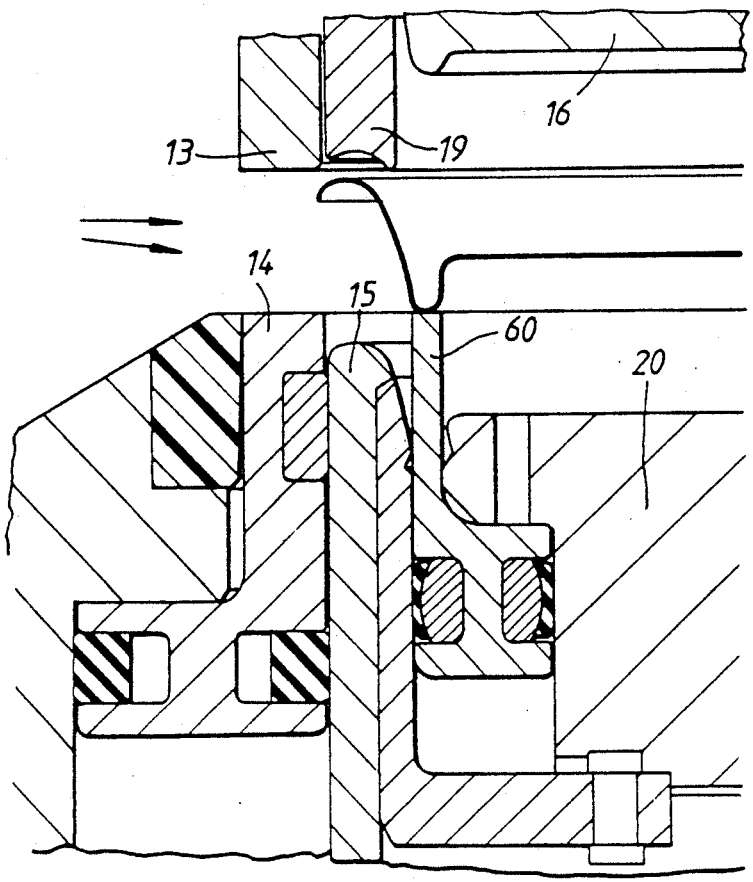

FIGS. 14 and 15 show alternative means for supporting the blank at the start and ejecting the shell at the end of the shell forming cycle respectively.

In this alternative the length of the ejector pressure ring 19 is increased and the ring 19 now applies pressure to the seaming panel portion of the shell through most of the forming action and strips the shell from the bore of the punch shell without the need for cam actuation at T.D.C. This leaves the shell in the die and a lift ring 60 is provided to lift the shell out of the die tooling as shown in FIG. 15. The lift ring 60 may be fluidically supported as shown or may for example be operated by a timed cam mechanism. The shell is finally removed from the tooling by conventional means such as a kicker or an air blast indicated by arrows in FIG. 15.

FIGS. 16 and 17 show in greater detail the overall arrangement of embodiments of the apparatus. The apparatus of FIG. 16 is modified from that described in European Patent Application no. 0153115 to which reference is made for a more detailed description of the overall construction and operation of the apparatus. In both FIGS. 16 and 17 the apparatus is shown at bottom dead center.

The main components of the apparatus of FIGS. 16 and 17 which have not been reference in the other drawings are as follows: punch plate 1, punch body 2, press bolster 3, lower pressure assembly 4, upper pressure assembly 5, stripper 6 and retainer 7.

Figure 18:
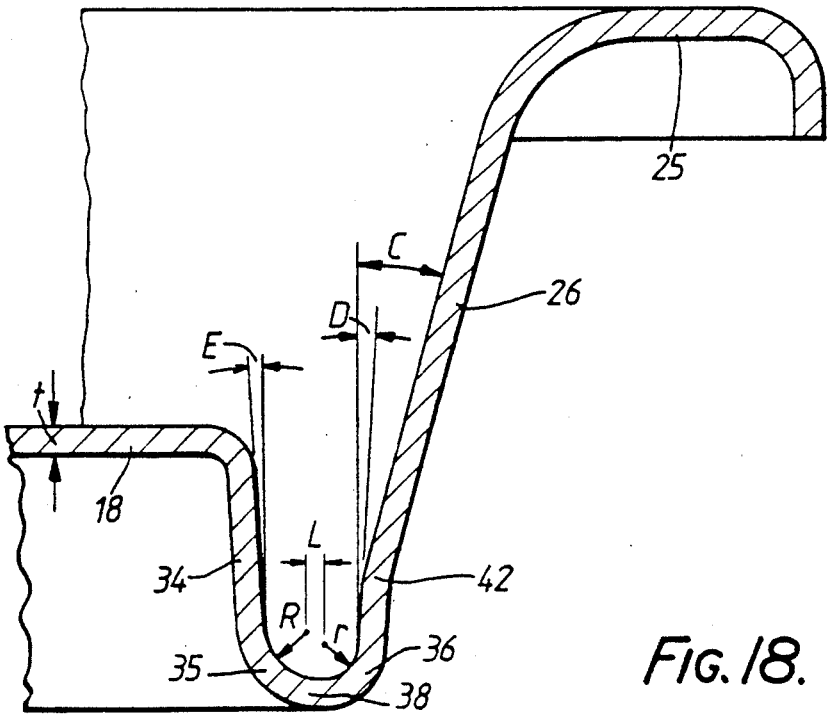
FIG. 18 shows a section through part of a finished can end shell.

FIG. 18 shows a partial section through a finished can end shell having been released from the apparatus. In the example, a can end shell has been made from 0.245 mm thick aluminium alloy 5182 in H19 temper. The thickness t of the central panel 18 is the same as the thickness of the sheet stock. The frustoconical chuck wall 26 is inclined to the axis of the shell at an angle C which is preferred to be in the range from 12° to 20° and more preferably in the range from 12° to 15°. The angle D representing the angle of the anti-peaking bead below the kink 42 is preferred to be in the range of 2° to 10° and more preferably is in the range of 2° to 4°. The angle E represents the inclination of inner panel wall 34 to the axis. The panel wall 34 is preferred to be parallel to the axis of the shell but may incline in either direction by up to 5°. A first annular portion 35 of the anti-peaking bead at its juncture with the panel wall has a radius of curvature R which is preferred to be in the range from 0.18 mm to 0.5 mm. A second annular portion 36 of the anti-peaking bead at its juncture with the chuck wall 26 below the kink 42 has a radius of curvature r which is preferred to be in the range from 0.18 mm to 0.43 mm.

An annulus 38 joins the first annular portion 35 to the second annular portion 36. Whilst we think it is preferable that R be greater than r, useful can ends may have R equal to r or R less than r. The centers of the radiuses R and r are spaced by a distance L.

The apparatus described above permits considerable control of the shape of the anti-peaking bead by choice of dimensions and adjustment of the travel of reform pad 21 to control how much of the frustoconical wall is transferred into the anti-peaking bead by entry into the recess 30, the width of which governs the width of anti-peaking bead created. A short travel will not create a kink 42: a longer travel will fill the "v" shaped undercut 32 and recess 30 to control the radii R, r.

Figure 19:
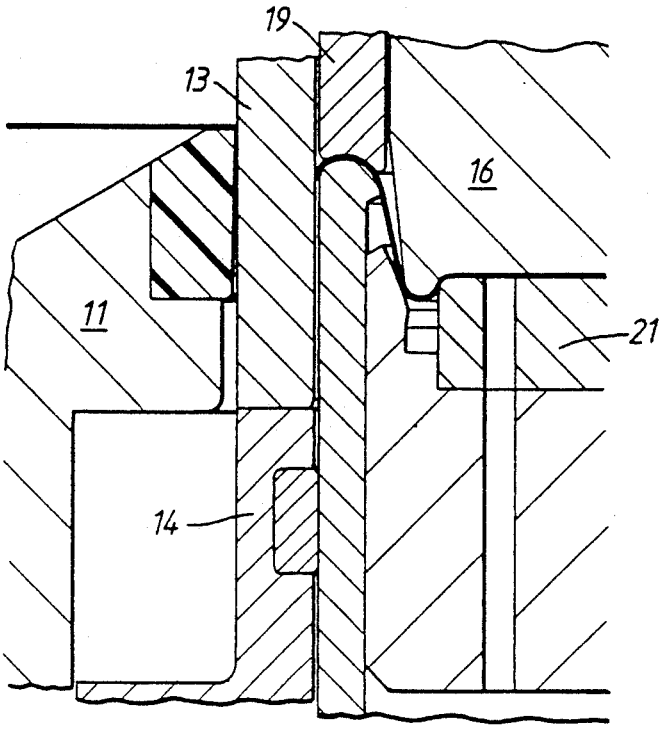
FIGS. 19–21 are partial views of a modified apparatus.
Figure 20:
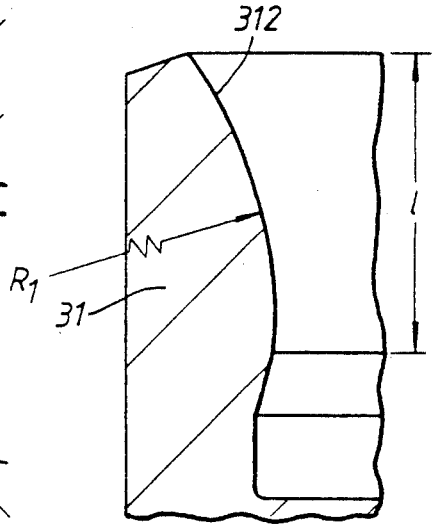
Figure 21:
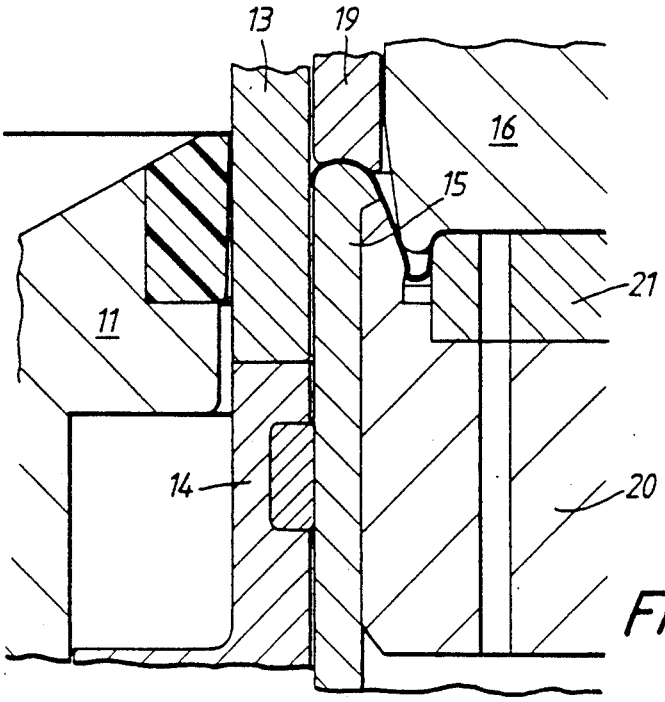

FIGS. 19 to 21 show a modification of the apparatus in which the frustoconical surface 311 has been replaced by a gentle convex arc 312, the curvature of which acts as a cam to time the rate of movement of chuck wall material into the evolving anti-peaking bead so that further control of the shape of the anti-peaking bead is achieved.

The apparatus shown in FIGS. 19 and 20 has many parts identical to those already described with reference to FIGS. 1 to 15 so that like functioning parts are denoted by the same integer numbers; such as the pressure sleeve 19 and punch center 16 of the top tool, and die center ring 15 of the bottom tool. However, in FIG. 19, it will be seen that the outer annular ring portion 31 of the reform pad has a gentle convex arcuate surface 312, best seen in FIG. 20. At bottom dead center, as shown in FIG. 19, drawing of the preliminary can end shell is complete and the chuck wall extends as a frustrum of a cone clear of both the side wall of punch center 16 and the convex arc 312 which has been pushed down by the punch center 16 acting through the sheet metal on the nose 21 of the reform pad.

FIG. 21 shows the apparatus of FIG. 19 at the end of the reforming operation, the outer ring portion 31 has risen to abut the beak of the die center ring 15 and, in so doing, has progressively pushed chuck wall material into the anti-peaking bead at a rate and a distance governed by the convex arc 312. In the manufacture of a can end of diameter 57 mm from aluminium alloy sheet 0.45 mm thick the convex arc has typically a radius R, of about 75 mm and extends a vertical distance of about 3.8 mm as shown on an enlarged scale in FIG. 20.

Choice of suitable dimensions for gentle convex arc therefore provides a means to localised modification of the shape of the anti-peaking bead. The lateral thrust delivered by the convex arc 312 or the frustoconical surface 311 may cause some advantageous thickening of the material of the anti-peaking bead.

In the embodiment of FIGS. 19–21 the nose 21 of the reform pad has a smoother profile; the V-shaped undercut 32 being omitted from this embodiment.

I claim:

1. Apparatus for forming a reinforced pressure resistant can end shell from sheet material, said apparatus comprising a cutting ring (11), a cutting punch shell (13) enterable into said ring (11) to blank out a disc of material therebetween, an annular draw ring (14) axially aligned with said cutting punch shell (13) to support a peripheral margin of the disc held against it by said cutting punch shell, a die center ring (15) arranged coaxially and axially slidably within the draw ring (14) and having an end face profiled to define a surface of a seaming panel of the can end shell, an ejector pressure ring (19) arranged coaxially and axially slidably within the cutting punch shell and axially aligned with the die center ring so that when in use peripheral material of the blank is restrained between the die center ring and the ejector pressure ring, a draw punch center (16) arranged coaxially and axially slidably within the ejector pressure ring and a reform pad (20) arranged coaxially and axially slidably within the die center ring to engage the central panel of the blank opposite the draw punch center; wherein the end profile of the draw punch center comprises an annular radiused nose (22) surrounding and defining a central substantially frustoconical recess (23), and the reform pad comprises a central cylindrical portion, dimensioned to deform the central portion of the blank around the nose (22) of the punch center and into the recess (23), and an outer ring (31), mounted on and axially slidable with the reform pad, spaced from the central cylindrical portion by an annular recess (30) dimensioned to receive the nose of the punch center; the outer ring having an inward facing substantially frustoconical face (311; 312) which flares outwardly from the recess (30), wherein the frusto-conical face (311; 312) of outer ring (31), when in its fully raised position relative to the die center ring (15) in the direction towards the ejector pressure ring (19), forms a substantially smoothly continuous surface with the end face of the die center ring and wherein the outer ring (31) is axially slidable within the die center ring from its fully raised position in the direction downwardly away from the ejector pressure ring under the influence of the draw punch center (16).

2. Apparatus according to claim 1 wherein the radially inner wall of the annular recess (30) is provided by a generally cylindrical wall (29) of the central cylindrical portion (21) of the reform pad, and is formed with an annular generally V-shaped undercut (32).

3. Apparatus according to claim 1 or claim 2 wherein the radially outer wall of the annular recess (30) is provided by a generally cylindrical wall of the outer ring (31) and is formed with an annular undercut (41) at its juncture with the frustoconical face (311;312).

4. Apparatus according to claim 1 wherein the die center ring (15) has a re-entrant surface which forms an axial abutment for the outer ring (31) in its fully raised position.

5. A method of forming a reinforced pressure-resistant can end shell comprising the steps of providing a substantially planar metallic blank having a central portion and a peripheral portion, deforming the blank in a first deformation stage to cause movement apart of the central and peripheral portions to offset said portions out of a common plane, thus drawing the blank into a generally flanged cup-shaped configuration defined by the central portion, a generally U-shaped channel extending about the central portion, a frustoconical wall and an annular seaming panel, and, in a second deformation stage, causing movement towards one another of the central portion and annular seaming panel to deform at least a part of the metal of the frusto-conical wall into the U-shaped channel to form an anti-peaking bead of the can end shell; and, during the second stage and simultaneously therewith, pushing the frusto-conical wall progressively radially inwardly toward the central portion.

6. A can end comprising a peripheral seaming panel (25), a frusto-conical chuck wall (26) depending from the inner periphery of the peripheral seaming panel, a generally U-shaped anti-peaking bead extending radially inward from the frusto-conical chuck wall, an annular wall extending upwardly in an axial direction from the inner periphery of the anti-peaking bead, a generally flat central panel supported within the frusto-conical chuck wall by said annular wall, characterized in that the anti-peaking bead comprises a first annular portion (35) of arcuate cross section extending outward from the annular wall (34), a second annular portion (36) of arcuate cross section extending inward from the substantially frusto-conical chuck wall (26), an annular connecting portion (38) joining said first annular portion (35) to said second annular portion (36), the radius of curvature R of the first annular portion (35) being less than the radius of curvature r of the second annular portion (36), said radius r being in a range between 0.18 mm and 0.43 mm, and the frusto-conical chuck wall (26) includes a kink (42) joining the second annular portion (36) to the frusto-conical chuck wall (26) at a level between the central panel and the connecting portion (38) and most immediately adjacent the connecting portion (38).

* * * * *